US009908030B2

(12) United States Patent
Shute et al.

(10) Patent No.: US 9,908,030 B2
(45) Date of Patent: Mar. 6, 2018

(54) CLIMBING AID COMPRISING A CLIMBING SKIN AND A TIP AND TAIL FOR USE THEREIN

(71) Applicant: G3 GENUINE GUIDE GEAR INC., Burnaby (CA)

(72) Inventors: Cameron Shute, Nelson British Columbia (CA); Edward James McCarthy, North Vancouver (CA); Robbie Gordon Roberts, Port Moody (CA); Michael Louis Coletti, Vancouver (CA); Oliver Steffen, North Vancouver (CA)

(73) Assignee: G3 GENUINE GUIDE GEAR INC., Burnaby, BC (CA)

( * ) Notice: Subject to any disclaimer, the term of this patent is extended or adjusted under 35 U.S.C. 154(b) by 0 days.

(21) Appl. No.: 15/341,211

(22) Filed: Nov. 2, 2016

(65) Prior Publication Data

US 2017/0120136 A1 May 4, 2017

Related U.S. Application Data

(60) Provisional application No. 62/249,720, filed on Nov. 2, 2015.

(51) Int. Cl.

| | |
|---|---|
| ***A63C 7/00*** | (2006.01) |
| ***A63C 7/02*** | (2006.01) |
| ***A63C 7/04*** | (2006.01) |

(52) U.S. Cl.

CPC . *A63C 7/02* (2013.01); *A63C 7/04* (2013.01)

(58) Field of Classification Search

CPC ..... A63C 7/00; A63C 7/02; A63C 7/04

See application file for complete search history.

(56) References Cited

U.S. PATENT DOCUMENTS

| | | | | |
|---|---|---|---|---|
| 6,471,234 | B2 * | 10/2002 | Ayliffe | A63C 7/02 24/265 R |
| 6,604,755 | B2 * | 8/2003 | Ayliffe | A63C 11/00 280/604 |
| 7,543,839 | B2 | 6/2009 | Hartmann | |
| 9,027,951 | B2 | 5/2015 | Holzer et al. | |
| 2008/0185817 | A1 | 8/2008 | Gyr | |
| 2010/0140901 | A1 * | 6/2010 | Rogers | A63C 7/04 280/604 |
| 2012/0189802 | A1 | 7/2012 | Puelacher | |
| 2013/0134691 | A1 | 5/2013 | Holzer et al. | |
| 2016/0045813 | A1 | 2/2016 | Mayrhofer et al. | |

FOREIGN PATENT DOCUMENTS

| | | |
|---|---|---|
| CA | 2547416 | 11/2006 |
| CH | 637839 | 8/1983 |
| DE | 8205601 | 9/1982 |
| DE | 9304437 | 7/1994 |
| WO | WO2010087721 | 8/2010 |
| WO | WO2014146159 | 9/2014 |

* cited by examiner

*Primary Examiner* — John D Walters
*Assistant Examiner* — James J Triggs

(57) ABSTRACT

Climbing aids for use on snow comprising a climbing skin and one or both of a climbing skin tip and tail are disclosed. At least the climbing skin tip and/or tail is comprised of a flexible sheet that may be composed of a plastic polymer. Embodiments are disclosed in which the sheet is resilient and curved in a generally transverse direction to transfer forces towards the edges of the climbing aid to reduce entry of snow between the climbing aid and the undersurface of a ski or snowboard.

30 Claims, 18 Drawing Sheets

CLIMBING AID COMPRISING A CLIMBING SKIN AND A TIP AND TAIL FOR USE THEREIN

RELATED APPLICATION

This application claims priority to U.S. provisional patent application No. 62/249,720 filed Nov. 2, 2015, the contents of which are incorporated by reference herein.

FIELD

This disclosure relates to climbing skins used with skis and snowboards.

BACKGROUND

Climbing skins are used on snow to assist in travelling forward along flat ground or in ascending a slope on skis or using the separate "halves" of a split snowboard. The climbing skin is attached to the undersurface of the ski or snowboard half. Originally, climbing skins were made from the skins of animals. Modern climbing skins typically comprise a fabric containing synthetic and/or natural fibers with a pile surface comprising a nap. The nap is preferably unidirectional. When such material is adhered or otherwise attached to the undersurface of a ski or snowboard half with the pile facing the snow and with the nap predominantly angled rearwardly relative to the direction of travel, the ski or snowboard half may be slid in that direction with relative ease yet will resist opposite movement such as what occurs when the ski or snowboard half slips backwards on a hill. Through the use of climbing skins, a user can ascend a reasonably steep snow slope through use of a walking or shuffling motion.

The leading (forward) end of a climbing skin is typically attached at or near the forward end of a ski or snowboard half. A variety of means for such attachment are known, such as those referred to in U.S. 2010/0140901, including a pair of clips as disclosed therein.

A variety of means are known for attachment of the rearward end of a climbing skin at the tail or a ski or snowboard half. Examples are disclosed in DE8205601, U.S. Pat. No. 6,604,755, U.S. Pat. No. 6,471,234, CA2547416, and US 2010/0140901. DE8205601 discloses a flexible elastic connector joined to the rearward end of a climbing skin with a hook or other device for attachment to the tail of a ski. The elastic component can contain a pattern of elements intended to resist rearward slippage. Such elements are shaped like cups or scales and have a gripping surface or edges that face towards the device for attachment to the tail of the ski.

It is also known to modify the gliding characteristics of a climbing skin by incorporating materials other than pile. For example, U.S. Pat. No. 9,027,951 disclosed a climbing aid comprising at least one climbing aid section and a sliding section. The sliding section extends from an end that is connected to a tip of a ski over a section that corresponds to a ski longitudinal section of between 20% and 50% of the ski length and which contains the "bent-up" portion of the ski. The "bent-up" portion is the portion which contains the aforementioned forward convex region of the undersurface of the ski or snowboard. US 2008/0185817 discloses a series of stiff, longitudinally cambered or flat plates to be bonded to a ski base (the ski undersurface). The device includes an optional glide zone made of thin plastic or other slippery material which is bonded to the skin (or which replaces pile material of the skin) and is attached at or near the tip of a ski. Each plate requires at least one strap or snap for retention to the ski, preferably located at or near the centre of the plate. Other examples of climbing skins with glide zones can be found in CH637839, DE9304437 and WO2010/087721.

The use of plastic polymer sheets allows for construction of a climbing skin that absorbs little water and can have enhanced forward glide when a pile or other fabric surface is not present. An example is disclosed in WO2014/146159, an embodiment of which is sold under the trademark PRO-FOIL and is made from a plastic polymer sheet, with an adhesive surface over its entire length for adherence to the undersurface of a ski. Across the width of the sheet are discrete regions of elements, at least some of which resist backward slippage.

It is preferred for a climbing skin to bear an adhesive on its surface that is intended to face the undersurface of the ski or snowboard half. Various such adhesives are known in the art for this purpose. Such an adhesive is typically one that remains sticky at low temperatures and permits repeated attachment and removal of a climbing skin from the undersurface of the ski or snowboard half. Such climbing skins are referred to in this document as "glued climbing skins". It is thought that the leading portion of a climbing skin that underlies the forward convex region of the undersurface of a ski or snowboard half should be adhered with such adhesive as best as possible without a gap (for example, see U.S. Pat. No. 9,027,951 at col. 7, lines 20 to 43). In order for the adhesive to remain sticky, the adhesive coated surface of the climbing skin should be kept clean and handled as little as possible. Snow building up on the adhesive surface will also reduce its adhesion to the ski or snowboard.

When in use, particularly in cold conditions, snow can creep between the glued climbing skin and the undersurface of the ski or snowboard resulting in loss of adhesion in that area, snow building up and the climbing skin peeling away from the ski or snowboard. This typically happens at the leading end of the climbing skin but also can occur at the rearward end.

It is desirable to reduce creeping of snow between a climbing skin and the undersurface of a ski or snowboard when in use, at least at the leading end.

SUMMARY OF INVENTION

A first aspect of the invention disclosed herein is directed to a climbing aid for use on snow comprising a glued climbing skin and one or both of a climbing skin tip and a climbing skin tail; the climbing skin tip comprising a forward attachment end, a rearward end joined to a leading end of the glued climbing skin and opposing gliding and back surfaces between said ends; the climbing skin tail comprising a rearward attachment end and a forward end joined to a rearward end of the climbing skin; wherein the one or both of said climbing skin tip and tail is comprised of a flexible sheet that is more rigid than the glued climbing skin, and wherein the back surface of the one or both of said climbing skin tip and tail is free of climbing skin adhesive and the gliding surface thereof has a minimum length of about 150 mm. In some embodiments, the sheet comprises a plastic polymer with a hardness of about 0 Shore D to about 100 Shore D.

A second aspect of the invention disclosed herein is directed to a climbing aid for use on snow comprising a climbing skin and one or both of a climbing skin tip and a climbing skin tail; the climbing skin tip comprising a forward attachment end, a rearward end joined to a leading end of the climbing skin and opposing back and gliding surfaces between said ends; the climbing skin tail comprising a rearward attachment end and a forward end joined to a rearward end of the climbing skin; wherein the one or both of said climbing skin tip and tail comprises a resilient sheet, the sheet comprising at least one longitudinal section that is curved in a generally transverse direction such that when laid flat, said back surface within the longitudinal section has the shape of at least a partial arch. In some embodiments, the sheet comprises a plastic polymer with a hardness of at least 40 Shore D and/or a flexural modulus of about 200 to about 900 Mpa determined according to ASTM D790.

A third aspect of the invention disclosed herein is directed to a climbing aid component for use in manufacture of a climbing aid comprising a climbing skin for use on snow, wherein the component is a climbing skin tip or a climbing skin tail, the climbing skin tip comprising a forward attachment end, a rearward end and opposing back and gliding surfaces between said ends; the climbing skin tail comprising a rearward attachment end, a forward end and opposing back and gliding surfaces between said ends; wherein the component comprises a resilient sheet comprising at least one longitudinal section that is curved in a generally transverse direction such that when laid flat, the back surface within the longitudinal section has the shape of at least a partial arch, and wherein the gliding surface has a minimum length of about 100 mm. The component may be one which is produced by molding of a polymer comprising a thermoplastic polyurethane so that the resilient sheet has a flexural modulus of about 200 Mpa to about 900 Mpa as determined according to ASTM D790.

It was surprising to find that presence of a climbing skin tip of the first aspect (as compared to presence of material of a glued climbing skin in the same area of a climbing aid) helps to prevent snow from building up between the skin tip and the undersurface of the ski or snowboard. This effect occurs even when no adhesive is used to adhere the climbing skin tip to the undersurface of the ski or snowboard. Nevertheless, it remains desirable to reduce creeping of snow, particularly in the areas at the tip and tail of the ski or snowboard and/or in areas where a side edge of the climbing skin is angled towards a direction of travel, regardless of whether adhesive is present. The second and third aspects provide for such improvement.

Various other aspects, as well as particular embodiments, features, and advantages thereof will be apparent from the following description and the appended claims.

BRIEF DESCRIPTION OF THE DRAWINGS

In the following description and in the claims, the term "snowboard" means a half of a split snowboard unless the context dictates otherwise.

DETAILED DESCRIPTION

Figure 1:
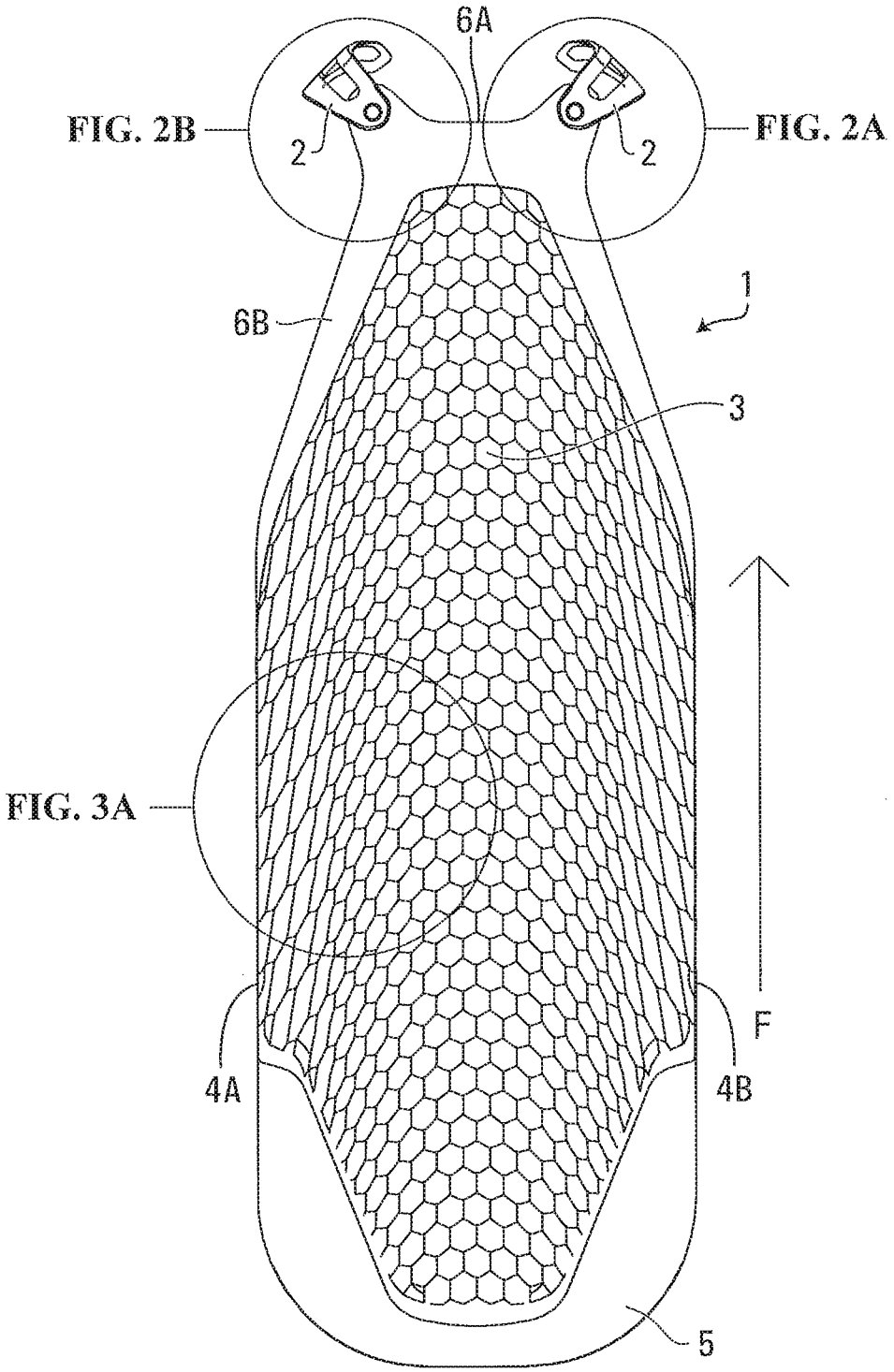
FIG. 1 is a plan view of a climbing skin tip without a climbing skin attached and having a grip pattern on its gliding surface. Arrow F is the direction of forward travel (the direction of glide).

One aspect disclosed herein is a combination of a climbing skin tip (skin tip) and a climbing skin which is representative of a climbing aid for use on snow as contemplated herein. The skin tip provides a gliding surface extending forward of the climbing skin. The skin tip may be sized so as to extend along the entirety of the forward convex portion of the undersurface of the ski or snowboard half. While the climbing skin portion of this combination will preferably be backed with an adhesive surface to adhere to the undersurface of the ski or snowboard, the portion of the skin tip that is not covered by climbing skin material will not be backed with adhesive. The present applicants have found that contrary to teachings in the prior art, one may provide a forward gliding surface on a glued climbing skin where the forward gliding surface extends along the forward convex region of the undersurface of a ski or snowboard in which the forward gliding surface is not adhered to the undersurface of the ski or snowboard. The forward gliding surface is flexible but more rigid than the climbing skin material and retained on the ski or snowboard only at its forward end by any suitable means (including one or more clips as disclosed herein) and at its rearward end through its attachment to the material of the climbing skin. Such embodiments provide the combined advantage of a forward surface that can be have greater glide than that provided by pile or the surface of other climbing skin material and which is not backed with climbing skin adhesive. This provides a convenient place for the user to handle glued climbing skins without touching the adhesive backing of a glued climbing skin. Presence of a skin tip lacking an adhesive surface and which is more rigid compared to the climbing skin material facilitates removal of the entire combination from a ski under awkward conditions since the user may detach the forward portion from the ski tip with a flicking motion after the climbing skin material itself is detached from the undersurface of the ski or snowboard.

The climbing skin tip in the preceding aspect comprises a sheet of flexible material. In some embodiments as described below, the material is flexible but resilient. The material may comprise a plastic polymer or another material such as a metal, a metal alloy or a combination thereof with appropriate flexibility/resilience.

The climbing skin tip in the preceding aspect may include a grip pattern such as those disclosed herein which may provide for additional resistance to rearward slippage and/or some resistance to lateral slipping, when the user is climbing steeply or edging into a hillside. The grip pattern is preferably one that minimizes resistance to forward glide. The skin tip grip pattern may comprise multiple zones of elevated portions across the width of the skin tip. Some zones may predominantly prevent rearward slippage. Some zones may be directed so as to face towards the centre of the skin tip. Some zones may obliquely face both the centre and the rear of the skin tip.

In combination with a climbing skin, a climbing skin tip of the preceding aspect may represent about 5% to about 50% of the length of the combined length of the climbing skin and skin tip, not including a tail strap. In particular embodiments, the skin tip will represent about 5% or about 15% to about 35% of that combination. In other embodiments, the skin tip will represent about 10% or about 15% to about 30% or about 35%. In other embodiments, the skin tip will represent about 15% or about 20% to about 30% or about 35%. In other embodiments, the skin tip will represent about 20% to about 25% or about 30%. In particular embodiments, the gliding surface of the skin tip has a minimum length of about 150 mm. Preferably the width of the leading edge of the climbing skin will be substantially the same as that of the rearward end of the skin tip.

Another aspect disclosed herein is a climbing skin tip that can be used in assembly of a climbing aid containing a climbing skin/climbing skin tip combination such as that described above. The skin tip of this aspect comprises one or more devices at a forward attachment end of the skin tip for use in attachment of the skin tip to the tip of a ski or snowboard. The one or more devices may be chosen from a variety known in the art for this purpose, including clips shaped to reach over one or both the opposite side edges of the tip of a ski or snowboard. The gliding surface of a skin tip of this aspect includes a grip pattern that changes from one that predominantly resists rearward movement opposite to the glide direction, to one that predominantly resists lateral movement of the skin tip relative to the glide direction. This change can be provided by a series of grip areas that have different orientation. Preferably, the change is substantially continuous from a centre region of the skin tip outwards towards each lateral edge of the skin tip. This can be accomplished by arranging grip elements along a curve that extends rearward and outwardly in both directions from the centre region of the skin tip. The pattern may be based on an array of primarily hexagonal portions which become increasingly elongated in a direction generally parallel with the glide direction going from the central area of the skin tip to each lateral edge.

A climbing skin tip of the preceding aspect may be sized to cover some or all of the forward convex region of the undersurface of a ski or snowboard and thus, may have a minimum gliding surface length of about 150 mm or more, measured rearward from the leading (forward) end of its gliding surface. Length may increase for different embodiments, for example in intervals of 5 or 10 mm up to a length of (for example) 800 mm. Preferred lengths are in the range of about 150 or 200 mm to about 500 mm, or about 200 or 250 mm to about 450 mm, or about 250 or about 300 mm to about 450 mm, or about 300 to about 350 mm to about 400 mm. The width of the skin tip may range from about 80 mm to well over 100 mm. The upper size will be chosen according to the width of the tip of a ski or snowboard with which the skin tip will be employed. Such a skin tip may be trimmed along its lateral edges by the user for custom fitting. The thickness of such a skin tip comprising a plastic polymer may range from about 0.5 mm to about 3, 4, 5 or 6 mm or more. Metallic materials may allow the skin tip to be thinner than the latter values. The skin tip may contain coring on its back side opposite to its gliding surface to minimize weight, adjust flexibility and/or to facilitate product production and quality in an injection molding process. Any suitable plastic material which can provide a glide surface having less friction on snow than climbing skin pile may be employed. Preferably, the material is more rigid than the climbing skin material and is relatively hard and non-porous. Examples of suitable plastic polymers are thermoplastics such as polyurethane and polyethylene. A particularly suitable material for manufacture by injection molding and for thermal bonding to the skin material is a thermoplastic polyurethane (TPU). TPU polymers that are polyethers can provide superior cold temperature characteristics. Generally, the hardness range of the plastic polymer employed in the skin tip will be chosen to provide for flexing of the skin tip along the forward convex ski or snowboard undersurface while maintaining a relatively close contact to that surface. The hardness may range from about 0 Shore D to about 100 Shore D or about 00 20 to about 80 Shore D, or about 20 Shore D to about 80 Shore D, or about 40 Shore D to about 80 Shore D, or about 55 Shore D to about 80 Shore D. Hardness of plastic products often correlates with its flexibility. A hardness of at least about 40 Shore D provides sufficient flexibility plus resilience for some embodiments disclosed herein.

A climbing skin tail or a climbing aid comprising a climbing skin and a climbing skin tail is also provided in which the climbing skin tail comprises a rearward attachment end and a forward end that is joined or intended to be joined to the rearward end of a climbing skin. Otherwise, the above-described features, limitations and advantages of a climbing skin tip and a climbing aid comprising same will apply mutatis mutandis to such a climbing skin tail. Thus, other aspects disclosed herein include a climbing aid for use on snow comprising a climbing skin and such a climbing skin tail as well as such a climbing skin tail for use in assembly of the climbing aid. In the latter aspect, the climbing skin tail may comprise one or more devices such as a strap for use in attachment at the tail or a ski or snowboard. In some embodiments comprising both the climbing skin tip and the climbing skin tail as disclosed herein in combination with a climbing skin, the proportions of the entire length of the climbing aid (not including a tail strap) made up by the climbing skin tip and the climbing skin tail combined will not exceed about 80%, or about 75%, or about 70%, or about 65%, or about 60%, or about 55%, or about 50% or a lesser amount.

Other aspects disclosed herein relate to climbing skin tip and tail components of a climbing aid as well as climbing aids that incorporate such a tip and/or tail which comprise a flexible yet resilient sheet that has at least one longitudinal section that is curved in a generally transverse direction such that when laid flat, the back surface in that longitudinal section has the shape of at least a partial arch. Such a sheet or a plurality of such sheets may be present in one or both of the climbing skin tip and the climbing skin tail, as well as in all or part of the climbing skin. In the case of a resilient sheet comprising a plastic polymer, the polymer may have a hardness of at least about 40 Shore D or a higher hardness value within the ranges discussed above. An upper limit for some embodiments with a resilient sheet is about 90 Shore D. The maximum arch height when laid flat may be at least about 1 mm, or at least about 1.5 mm, or about 2 mm, or about 2.5 mm, or about 3 mm, or about 3.5 mm, or about 4 mm or more. That height corresponds to the maximum height of a concavity that can be present between the curved sheet and a planar surface on which the sheet is laid flat. Embodiments making use of metallic material for the sheet may include spring steel with a thickness in the range of about 0.15 mm to about 0.3 mm and the arch height in such an embodiment can be less than that for a plastic polymer sheet. In either case, the arch will preferably span more than half, or span at least about two-thirds, or span substantially all of the width of the climbing aid at the location of the arch. Ideally, the arch will span substantially all of that width. In some embodiments, the arch is a symmetrical arch.

The arch described above transfers force from its centre towards the side edges of a climbing aid. Such a force can be created by pressing on snow when the climbing aid is in use and/or when a region of the climbing aid containing the arch is bent around a convex surface present on the underside of a ski or snowboard. Such force when transferred towards the side edges of the climbing aid helps keep snow from creeping in and building up between the climbing aid and the undersurface of the ski or snowboard. The sheet may comprise materials as disclosed above for the previous aspects. A curved plastic polymer sheet for this aspect may have a flexural modulus of about 200 Mpa to about 900 Mpa as determined according to ASTM D790 (for example, the 15e2 version). In some embodiments, that flexural modulus will be about 300 Mpa to about 800 Mpa, or about 300 Mpa to about 700 Mpa, or about 400 to about 600 Mpa, or about 500 Mpa. The plastic polymer may be a polymer as described above for the preceding aspects, including polymers that comprise a thermal plastic polyurethane. Average thickness for the curved sheet may correspond to the ranges of thicknesses referenced above for a climbing skin tip or tail. Furthermore, a climbing skin tip, climbing skin tail or climbing skin of this aspect may have any other features, limitations and/or advantages described for preceding aspects where the circumstances allow except that in this aspect, the proportion of the entire length of a climbing aid that contains such a sheet may be as much as 100% (not including a tail strap). Thus, some embodiments of this aspect are climbing aids for use on snow comprising such a skin tip and/or such a skin tail and a climbing skin comprising multiple sheets or a single continuous sheet in which all or multiple longitudinal sections thereof are curved in a generally transverse direction to provide the arch as described above. In some embodiments, the climbing aid bears a climbing skin adhesive throughout some or all of its length. Furthermore, the length of the gliding surface of the ski tip or tail of this aspect may be less than the lengths mentioned for the preceding aspects. For example, the minimum length of the gliding surface in this aspect may be about 100 mm or more, or about 100 to about 150 mm, or about 125 to about 200 mm, or about 150 to about 200 mm, or greater. Furthermore, some or all of the gliding surface of embodiments in this aspect (the surface facing away from the undersurface of the ski or snowboard) may comprise a grip pattern, a pile or other climbing skin material surface or a combination thereof.

Presence of a transversely oriented arch in this aspect allows for varying the width of the climbing aid along its length whereby the side edges of one or more regions of the climbing aid face or are angled towards a glide direction while still reducing snow creep in those regions as a result of the transfer of force towards the side edges of the climbing aid. For example, the leading end of the climbing aid may be narrower in width than rearward portions of the climbing aid and/or the rearward end of the climbing aid may be narrower in width than more forward portions of the climbing aid. This saves weight and can expose more of the underside of the ski or snowboard to enhance forward glide. The shape of the climbing aid in these regions can result in divergence of a lateral edge of the climbing aid at an angle from a central axis. Typically, the angle will be about 30° or up to about 45°. When such an angled portion faces towards the direction of travel, presence of the arch helps reduce rearward snow creep. Sometimes, it is necessary to slide a ski or snowboard half rearward such as during a kick turn, in which case providing such a narrowing in width towards the rearward end of the climbing aid can facilitate such motion and presence of the arch in that region will reduce the tendency for the snow to creep forward under the tail of the climbing aid during such maneuvers. Since the tail of many skis and snowboards also contain a convex undersurface, bending the climbing aid over that region at the tail increases transfer of force to the side edges of the climbing aid, just as is the case at the ski or snowboard tip.

Another aspect disclosed herein relates to manufacture of climbing skin tips, climbing skin tails and climbing aids as described above. Various methods are known in the art for forming and/or shaping sheet material including methods that involve application of heat, pressure or a combination thereof. While continuous mechanical production using one or more shaped rollers is possible to provide part or all of a climbing aid, we find that injection molding is a preferred method, particularly for production of individual climbing skin tips and skin tails comprising a plastic polymer. In such a process, the mold is shaped and dimensioned to provide a climbing skin tip or tail having the desired features and dimensions. The interior surfaces of the mold may be shaped to provide a grip pattern and/or a back surface containing "coring" as described herein. The gliding surface of such a tip or tail is preferably chamfered at the side edges to minimize relief at those edges. The mold may contain one or more surfaces curved in a generally transverse direction to form one or more arches in the finished product, as described above. The curved surface may be at the back surface only or it may be present on both the back and the opposite surface so that a curved surface will be extended in both the back and gliding surfaces of the product. The process comprises filling such a mold with the desired plastic polymer in a molten form followed by cooling whereby the polymer hardens and the product may be removed from the mold. A further aspect of this application is a climbing skin tip, a climbing skin tail or a climbing aid produced by injection molding according to such a process.

Another aspect disclosed herein relates to a clip, at least one of which may be used for attachment to the tip of a ski or snowboard. Such a clip is preferably pivotally attached at one end thereof to the forward end of the climbing aid (climbing skin or climbing skin tip/climbing skin combination). Such a clip can be used in combination with climbing skins as known in the prior art as well as with the skin tips and climbing aids described herein. The design of this clip significantly reduces damage caused in use when one ski or snowboard half is raised and moved forward past the tip of a stationary ski or snowboard half when walking or climbing. The shape of the clip in the portion that will lie on the upper surface of the ski or snowboard is such that it minimizes impact by a corresponding clip or other part on the other ski or snowboard half as the other passes over the stationary ski or snowboard half that employs the clip disclosed herein.

The attached drawings illustrate exemplary embodiments within the various aspects described above.

FIG. 1 is a plan view showing the gliding surface of skin tip 1. Arrow F shows the forward glide direction which corresponds to the normal direction of travel of a ski or snowboard. A pair of clips 2 are pivotally attached in opposing manner at a forward attachment end of the skin tip. These clips are used to retain that end of the skin tip on the tip of a ski or snowboard. In this application, reference to the "tip" of a ski or snowboard refers to the forward end of the ski or snowboard in the normal direction of travel whereas the term "tail" refers to the rearward end of the ski or snowboard.

The embodiment illustrated in FIG. 1 has a grip pattern with repetitive elements that extend laterally towards both side edges of the climbing skin tip (4A and 4B) from a centre region 3 of the skin tip. The rearward end 5 of the illustrated embodiment includes a generally U-shaped bib which is thinner than the majority of the skin tip and is used in joining the skin tip to the leading end of a climbing skin. Typically for this embodiment, the bib is sandwiched and bonded between layers of the climbing skin material. In the illustrated embodiment, the thickness of the skin tip in the areas to which clips 2 are attached and in the patterned grip area generally ranges from about 2 to about 3 mm, whereas bib at end 5 ranges from about 1 mm to about 0.5 mm at its edges. The area behind leading edge 6A and in side areas 6B taper to a lesser thickness going from the patterned grip area to the edge of the skin tip. In this embodiment, the overall length of the skin tip from the clips to the bottom of the bib is about 390 mm. The length of the skin tip from the leading edge 6A of the gliding surface of the skin tip to the bottom of the bib is about 370 mm. The length of the gliding surface to the rearmost end of the grip pattern is about 340 mm. The skin tip is flexible but not stretchable or elastic in ordinary use. In a particular embodiment, the skin tip has a hardness of about 65 Shore D and is manufactured by injection molding using Amtaitech™ Isothane 3065 polymer. Alternative materials include the Amtaitech™ Isothane 3055 polymer with a hardness of about 55 Shore D. Side edges 4A and 4B of such a skin tip can be easily trimmed for fitting to skis of various widths. For example, the width of the skin tip at its maximum point in the illustrated embodiment may be about 130 mm.

Figure 2A:
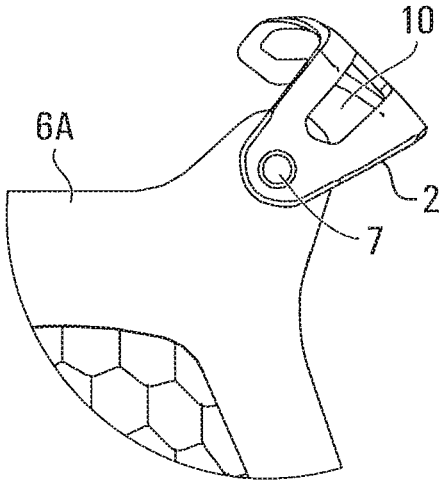
FIG. 2A is an enlarged view of portion A of FIG. 1 showing a clip for attachment of the forward end of the climbing skin tip to the tip of a ski or snowboard half.
Figure 2B:
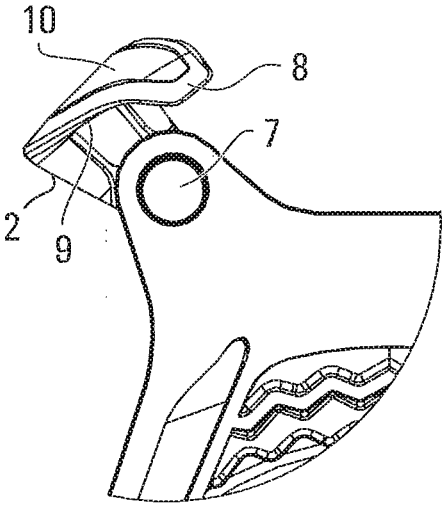
FIG. 2B is an opposite view of FIG. 2A showing the free end of the clip facing outwards.

FIG. 2A and FIG. 2B are enlarged views of opposite surfaces of portion A of FIG. 1 to better illustrate clip 2. In the embodiment illustrated in FIG. 1, a pair of such clips are placed in opposing orientation at the forward attachment end of the climbing skin tip and are fastened to the skin tip by pivoting fasteners 7. Clip 2 is shaped to extend around a side edge at the tip of a ski or snowboard so that the free end 8 of clip 2 will hook over and lie on the top surface of the ski or snowboard. While the shape is generally U-shaped nearer the pivot, free end 8 is skewed in a direction forward of the skin tip. It has been found that this shape allows for edge 9 of clip 2 to be positioned on the top surface of a ski or snowboard in a manner that reduces contact with the other ski or snowboard as compared to prior art clips which are generally "U-shaped" through to the free end of the clips. Reduction in the possibility of damage to the clip allows for weight reduction options, for example by the use of cut-away openings 10 as illustrated. The body of clip 2 is typically metallic but may also comprise a non-metallic material such as an injection molded plastic material.

Figure 3A:
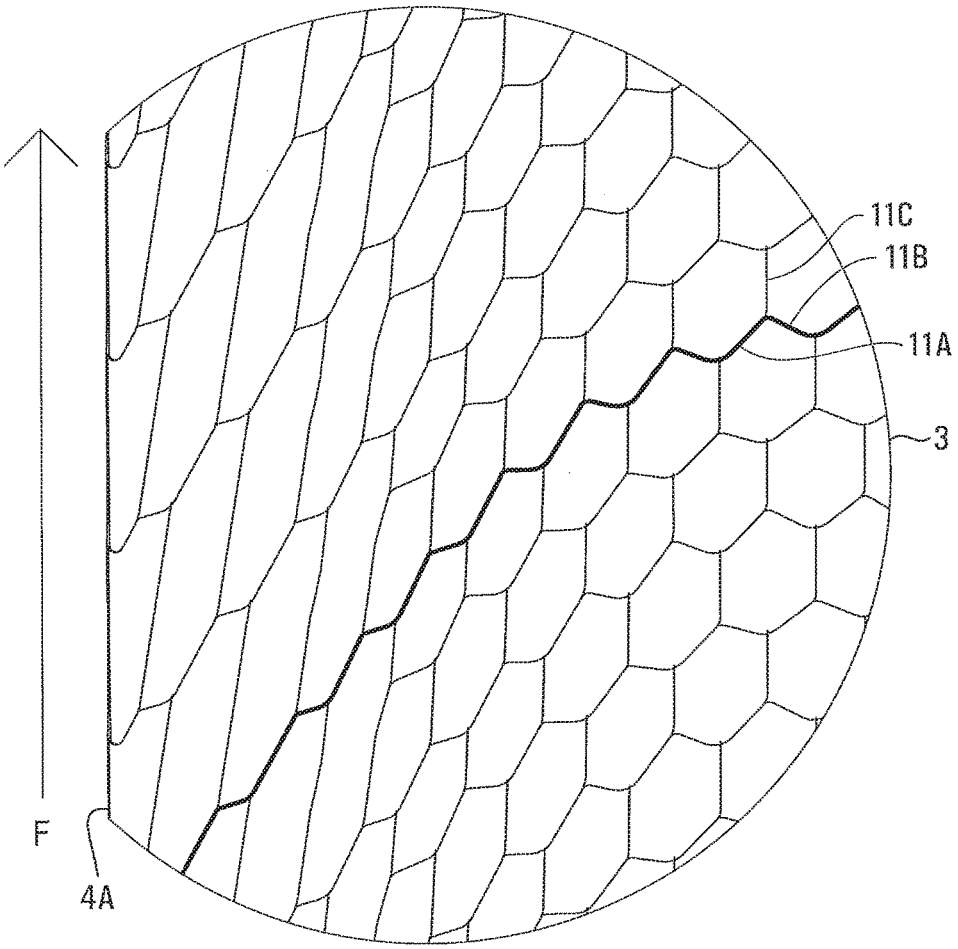
FIG. 3A is an enlarged view of portion B in FIG. 1. The bold line represents a triangle wave component of the grip pattern, arrayed along a curve.

FIG. 3A is an enlarged view of portion B of FIG. 1 showing a preferred grip pattern. The pattern is such that it continuously alters so that elevated edges are oriented to predominantly resist rearward slippage near the centre of the grip pattern, and which progressively become oriented to lie along the direction of travel and face the centre of the grip pattern towards each lateral edge of the climbing skin tip. The elevated edges situated nearer the side or lateral edges of the skin tip and which face more towards the centre of the grip pattern may be greater in height than the elevated edges nearer the centre of the skin tip. As in the illustrated embodiment, this can be accomplished by arranging the grip pattern to progressively change along a curve, with a forward most point of the curve located centrally on the skin tip and which extends rearwards towards each side edge of the skin tip. The line in bold shown in FIG. 3A follows such a curve. Elevated edges along this line form an elevated, triangular wave which is more effective to prevent rearward slippage near the centre region 3 of the skin tip. The side 11A of each triangle in the wave further away from the centre progressively increases in length going towards the side edges of the skin tip, while the side 11B of each triangle closer to the centre of the skin tip progressively decrease in length. Such a pattern can be designed by modelling the glide surface on a tiling of a plurality of hexagonal elements of various types, incorporating other polygons as necessary to achieve the desired result. The use of hexagonal elements as illustrated in FIG. 1 provides an array of elevated edges for grip that extend along a curve and which progressively change from ones which tend to resist rearward movement in region 3 to ones which face more towards the centre of the skin tip as the curve extends towards each lateral edge (4A and 4B) of the skin tip. The elevated edges that face more towards the centre of the climbing skin tip assist in reducing sideways slippage of the attached ski or snowboard when the user is edging into a hill. By providing a range of differing orientations of the elevated edges, the skin tip is more responsive to reduce sideways slippage with changing slope angle or angle of attack. The edges that face more towards the centre of the climbing skin tip present less drag and therefore can be elevated more than the edges which on average face more rearwardly while still allowing for a similar amount of glide. A further advantage in the use of hexagonal components is that each hexagon (and other accompanying polygons) can be treated as separate plates or scales, each angled relative to the horizontal plane of the skin tip to provide for different heights of the elevated edges. Use of hexagons in this manner results in the inclusion of a number of edges 11C which are essentially parallel to glide direction F. While such edges do not interfere with glide, they can serve the purpose of reducing a suction that may occur between smooth plastic on the skin tip and a snow surface.

Figure 3B:
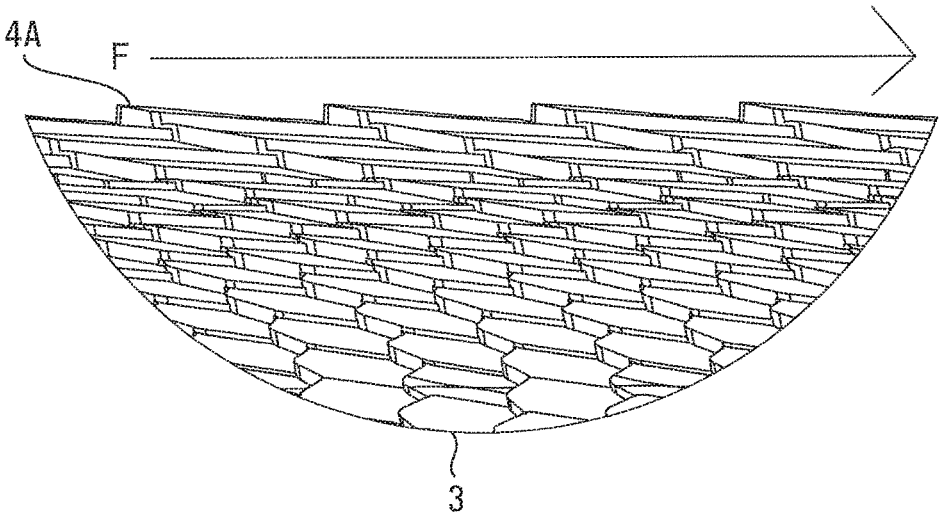
FIG. 3B is a partially rotated, perspective view of FIG. 3A showing edges and elevated sides of polygonal components of the grip pattern. The bold line of FIG. 3A is not shown.

FIG. 3B is a partially rotated view of the enlarged portion shown in FIG. 3A in perspective to better illustrate the orientation and different heights of the elevated edges. The grip pattern of a climbing skin tip such as that illustrated in these drawings can be designed using modelling software such as Solidworks™ or Pro/E™.

Figure 4:
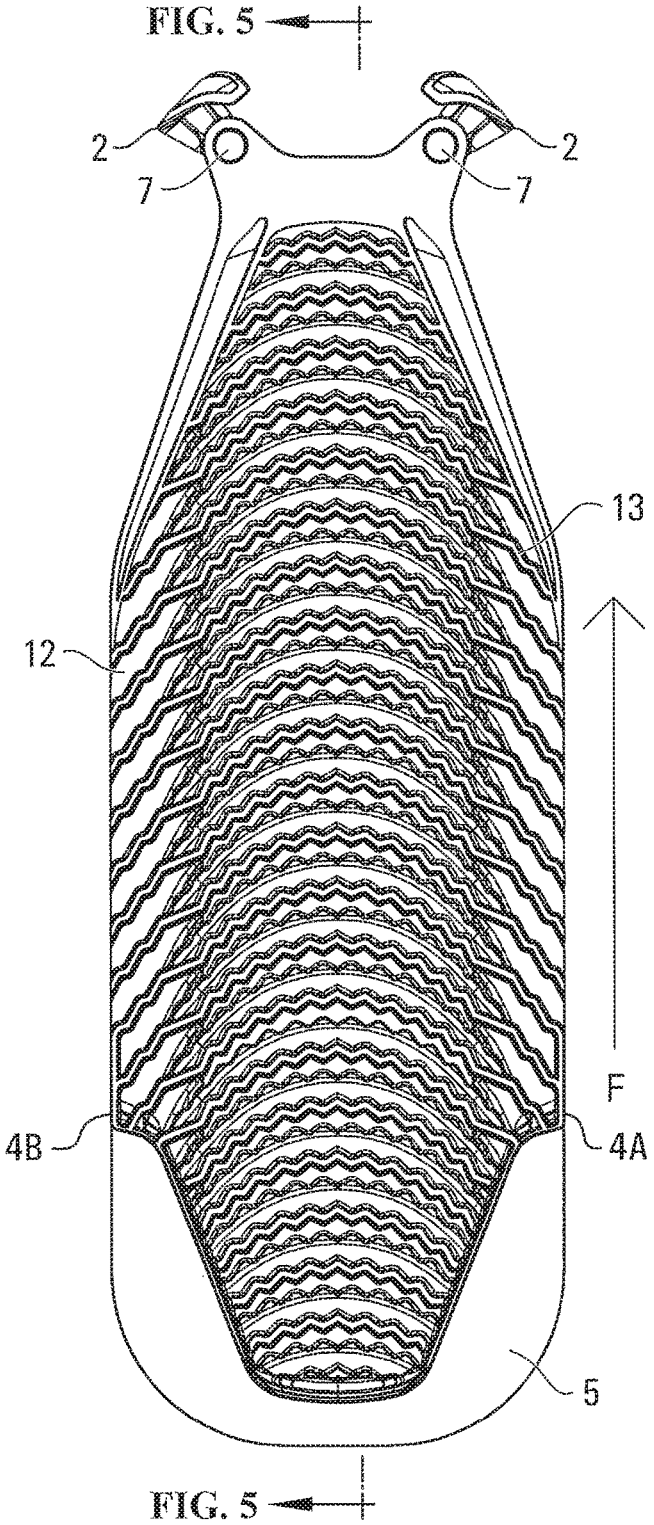
FIG. 4 is a plan view of the opposing surface of the skin tip illustrated in FIG. 1, which is the surface that will be placed against the undersurface of a ski or snowboard half.

The climbing skin tip may be advantageously produced by injection molding of a thermal plastic. This process is ideal for reproducing a complex, evolving pattern such as a grip pattern as described above. The injection molding process also allows for "coring" features to be included on the back surface of the skin tip, which is the surface of the skin tip intended to face the undersurface of a ski or snowboard. This can be accomplished by the introduction of channels, depressions, ridges, etc., on a core side of the injection mold. FIG. 4 illustrates a typical coring pattern designed to reduce variation in average thickness of the skin tip and to reduce overall weight. Thinner regions are found in areas such as depressions 12 and in the areas between ridges 13. Although the applicants have found that a climbing skin tip such as that illustrated can be used without an adhesive to hold it to the undersurface of the ski or snowboard and without excessive separation of a rearwardly situated glued climbing skin from the ski or snowboard, the coring on the back side of such a skin tip can be arranged (such as by use of ridges 13) to help direct any snow that does accumulate between the back of the climbing skin tip and the undersurface of a ski in an outwards direction.

Figure 5:
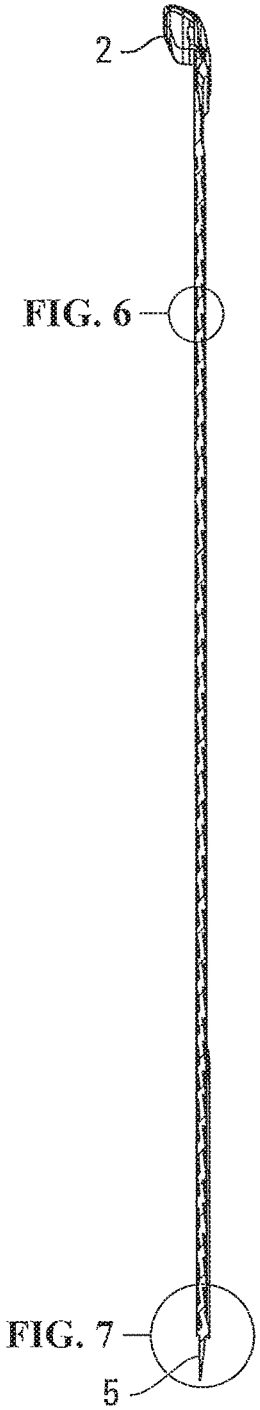
FIG. 5 shows a cross-section along line C-C of FIG. 4.

FIG. 5 is a sectional view along line C-C in FIG. 4. Difference in thickness between the bib at rearward end 5 and the portion of the gliding surface of the climbing skin tip which in this case comprises a grip pattern, can be seen. A side view of clip 2 is illustrated.

Figure 6:
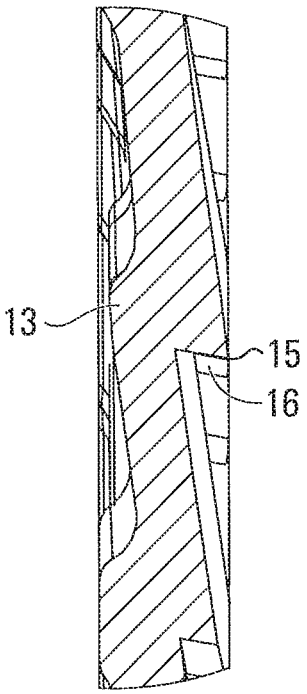
FIG. 6 is an enlarged view of portion D of FIG. 5.

FIG. 6 is an enlarged view of portion D of FIG. 5 showing an elevated edge 15 of the grip pattern relative to adjacent, generally horizontal surface 16. In this embodiment, surface 16 that elevates edge 15 is undercut by about 10 degrees to provide for better grip and prevention of rearward movement opposite to forward direction F.

Figure 7:
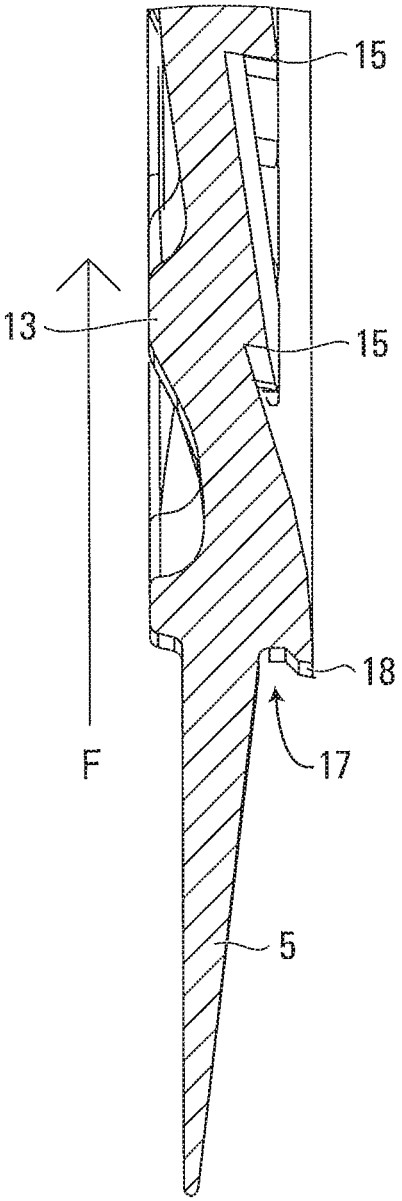
FIG. 7 is an enlarged view of portion E of FIG. 5.

FIG. 7 is an enlarged view of portion E of FIG. 5 showing cavity 17 that extends around the interface between the bottom of the grip pattern on the skin tip and the bib at rearward end 5. This cavity allows for the insertion of a leading edge of the climbing skin material so that the leading edge will be protected from catching or abrasion. It is contemplated that lip 18 of cavity 17 may be extended further rearwardly in a plastic polymer version of the illustrated embodiment so as to be pressed and bonded into the pile of climbing skin material at the leading edge of the climbing skin during manufacture.

Figure 8:
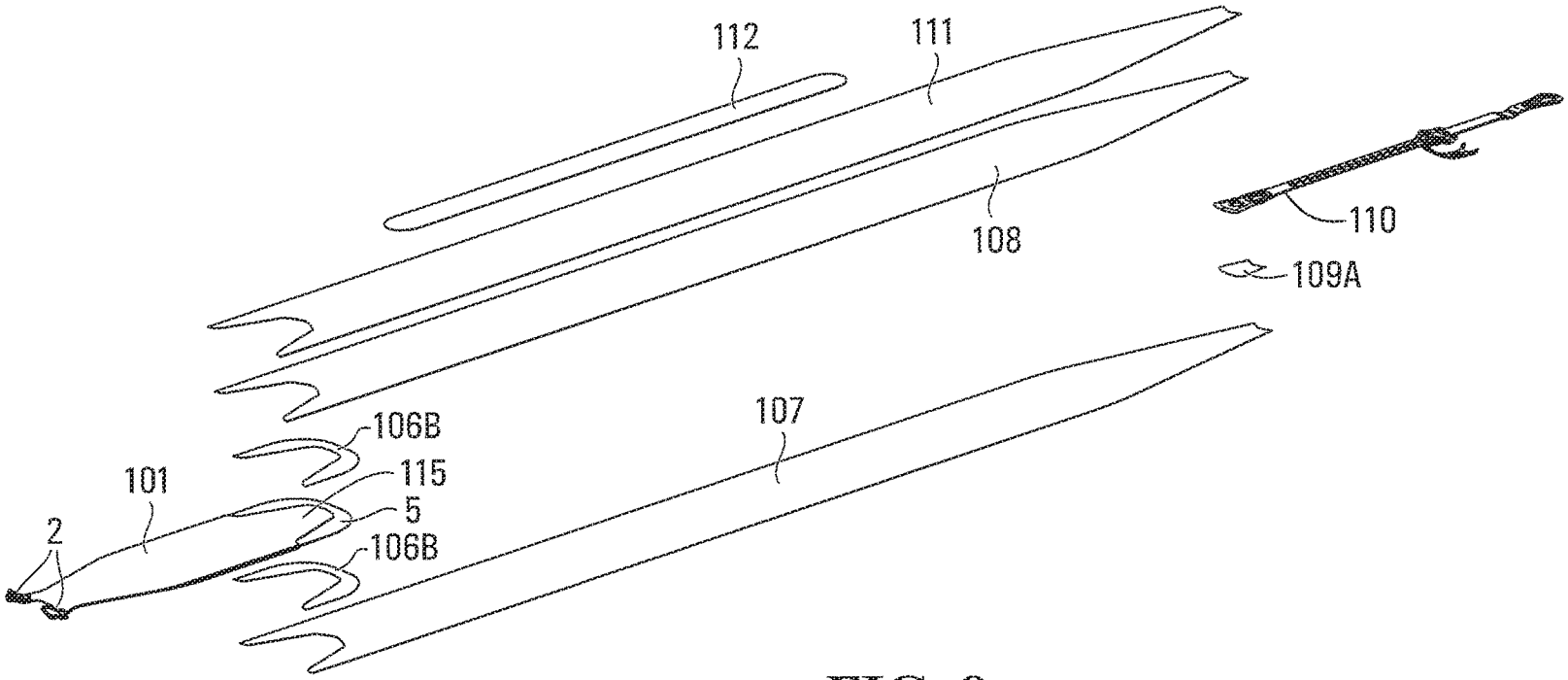
FIG. 8 is an exploded view of components arranged for assembly to produce a climbing aid including a skin and a climbing skin tip with a strap at its rearward end for use in attachment at the tail of a ski or snowboard half.

FIG. 8 shows an exploded view of the components of an embodiment of a climbing aid comprising a combination of a climbing skin and climbing skin tip. The gliding surface of climbing skin tip 101 in this embodiment does not comprise a grip pattern but it may have a grip pattern and/or be cored in its back surface as described above. Clips 2 as previously described are present on the skin tip at this stage or are added later. The generally U-shaped bib at rearward end 5 will be the centre layer of a sandwich containing layers of polyurethane laminate 106A and 106B, and climbing skin pile layer 107 and climbing skin backing layer 108. At the rear is another layer of polyurethane laminate 109A employed to join strap 110 between pile layer 107 and backing layer 108. The strap is used for attachment of the rear end of the climbing skin to the tail of the ski or snowboard. The latter components are pressed together and heated so as to thermoform a unitary climbing aid comprising a climbing skin tip/climbing skin combination. Adhesive layer 111 may then be added on the outer surface of backing layer 108 at an appropriate time so as to be opposite the pile surface provided by layer 107. Optional adhesive modification strip 112 may then be placed centrally on the adhesive side of layer 111 to eliminate tackiness in the area of strip 112. This can reduce the amount of effort required to separate the resulting glued climbing skin from the undersurface of a ski or snowboard.

Although the climbing skin tip may be adapted for joining to climbing skin material by means of thermal bonding using a thermoplastic laminate as described above, it should be recognized that any suitable means known in the art for joining components of a climbing skin may be employed to join a climbing skin tip as described herein with material of a climbing skin. For example, a skin tip may or may not contain a component corresponding to a bib at rearward end 5. The skin tip may be attached to climbing skin material by a variety of ways including chemical bonding and mechanical fastening. Mechanical fastening includes sewing a plastic polymer climbing skin tip to the climbing skin material. It is also contemplated that the skin tip may be provided to a user in a kit including a length of climbing skin material so that the user may attach the skin tip to a leading edge of the climbing skin material through the use of suitable fasteners such as snaps, rivets or threaded fasteners such as those described in U.S. 2010/0140901 for such purpose. A sliding element with a channel that engages with an enlargement on the leading end of climbing skin material and/or on the rearward end of the skin tip may also be used to form the attachment. Additionally, a plate or other such member may be employed to join and/or sandwich the skin tip and the climbing skin material. A kit provided to a user may contain a climbing skin material, one or more skin tips and one or more fasteners for joining them.

Figure 9:
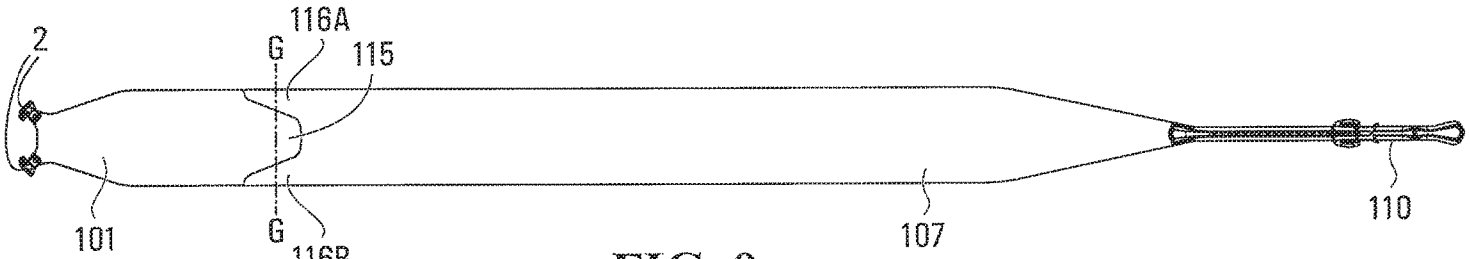
FIG. 9 is a bottom view of an assembled version of the climbing aid illustrated in FIG. 8.

FIG. 9 shows the snow contact surface of the assembled climbing aid with rear strap illustrated in FIG. 8. The gliding surface of skin tip 101 is shown, as is the pile surface of layer 107. When assembled, the pile extends forward on areas 116A and 116B on opposite sides of portion 115 of the skin tip. Thus, in the embodiment illustrated in FIG. 9, the exposed surface of skin tip 101 is a gliding surface (which may also contain a grip pattern) and the pile surface of 107, including areas 116A and 116B forms the climbing aid or grip surface of a climbing skin which functions in the usual manner. The gliding surface of the skin tip provides greater glide than the climbing skin portion.

Figure 10:
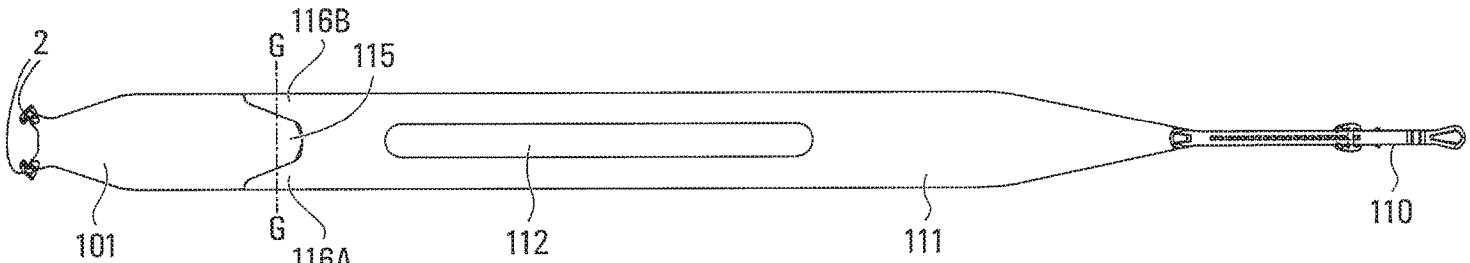
FIG. 10 is a top view of the assembled climbing aid illustrated in FIG. 9.

FIG. 10 shows the reverse side of the embodiment illustrated in FIG. 9, which is intended to face the undersurface of a ski or snowboard and be so attached by means of adhesive layer 112, clips 2 and strap 110. The surfaces of areas 116A and 116B in this view are coated with a climbing skin adhesive but the exposed back surface of skin tip 101 (including portion 115) is not. Presence of adhesive on the back surface of forward extending regions 116A and 116B of the pile contacting climbing skin material has also been found helpful to reduce peeling of the climbing skin portion of this combination from the side surface of the ski or snowboard even while the exposed back surface of this skin tip is free of adhesive. Other shapes of the interface between portion 115 and regions 116A and 116B are also contemplated, including a more V-shaped arrangement or arrangements in which a curve or a complex curve defines the interface.

Figure 11:
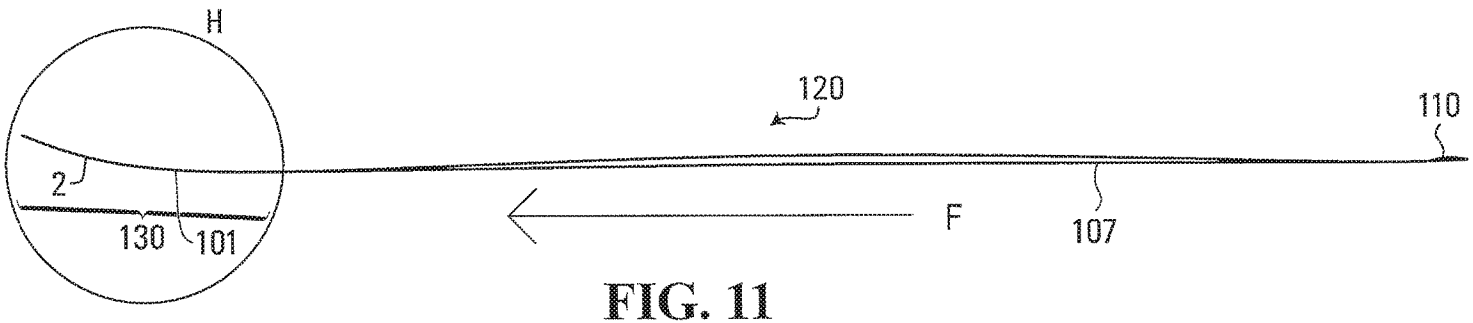
FIG. 11 is a side view of a conventional ski with the climbing aid illustrated in FIGS. 9 and 10 attached to and extending along the undersurface of the ski. Portion H intersects the combination at the location of line G-G in FIGS. 9 and 10.

FIG. 11 shows a side view of a conventional ski 120 with a climbing aid comprising a skin tip/climbing skin combination as illustrated in FIG. 10 placed against the undersurface of the ski. Portion H illustrated in FIG. 11 intersects the ski at the location of line G-G as illustrated in FIG. 9 and FIG. 10. This line represents a position approximately midway between the most rearward transition of the gliding surface of skin tip 101 and the climbing skin material. As shown in FIG. 11, this intersection occurs beyond the rearward end of the forward convex region 130 of the undersurface ski 120. Placing a plastic glide surface, with or without a grip pattern on this region of the ski or snowboard undersurface decreases effort when trail breaking and can increase glide (particularly in soft snow). It has been surprisingly discovered that absence of an adhesive layer in this region does not adversely affect retention of a glued climbing skin on the ski or snowboard in use, while providing further advantage in terms of ease of handling.

Figure 12A:
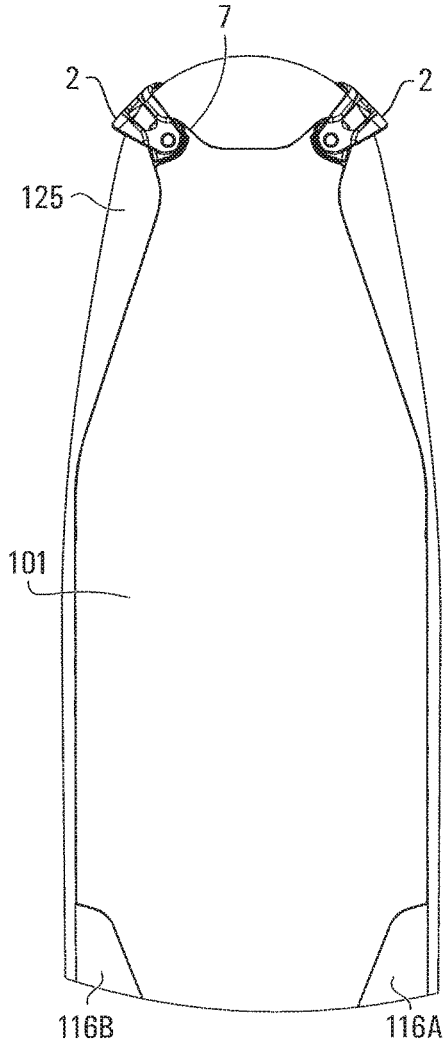
FIG. 12A is a bottom view of portion H showing exposed portions of the undersurface of the ski and the surface of the climbing skin tip containing its gliding surface.

FIG. 12A is a bottom view of portion H in FIG. 11. The surface of climbing skin tip 101 shown is part of its gliding surface. Areas 116A and 116B are pile. Exposed portions 125 of the undersurface of the ski are shown. The pivotal end portions of clips 2 are illustrated. The free ends of clips 2 are not visible in this view since they wrap around the edge of the ski tip.

Figure 12B:
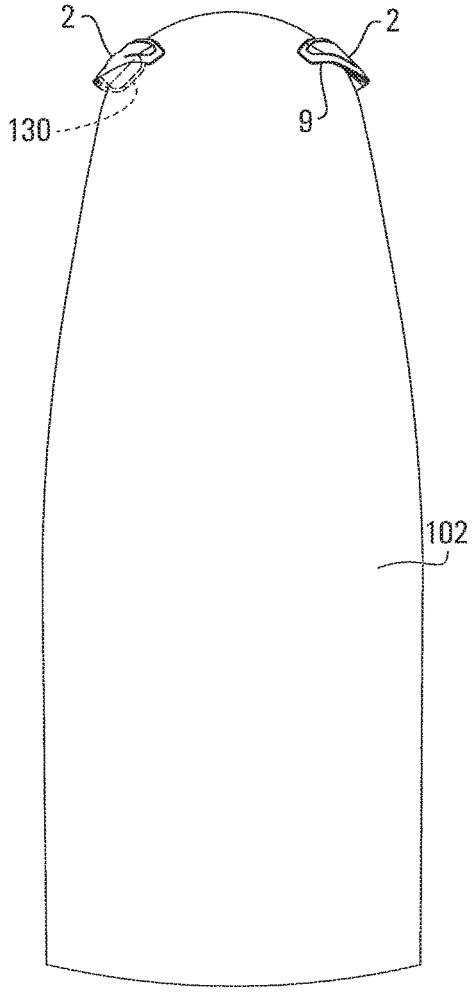
FIG. 12B is a top view of portion H showing the position of the clips of the skin tip on the upper surface of a ski. The position of a prior art clip is shown in phantom line on one side of the ski, for comparison.

The free ends of clips 2 that will lie on the upper surface of the ski tip are illustrated in FIG. 12B. This drawing shows the upper surface of the tip of ski 120 and the free ends of clips 2 extending around a side edge of the ski tip. On one side of FIG. 12B is phantom outline 130 showing the relative position of the free end of a prior art clip. The applicants have found that shaping clip 2 as illustrated herein reduces damage to the clips when in use. This shape is provided by skewing the free end of clip 2 in a forward direction relative to the skin tip to which the clip is pivotally attached. This allows edge 9 to lie along a line that is approximately transverse to the direction of glide or which is directed forwardly relative to glide direction F rather than extending more rearwardly as shown by phantom line 130.

Figure 13:
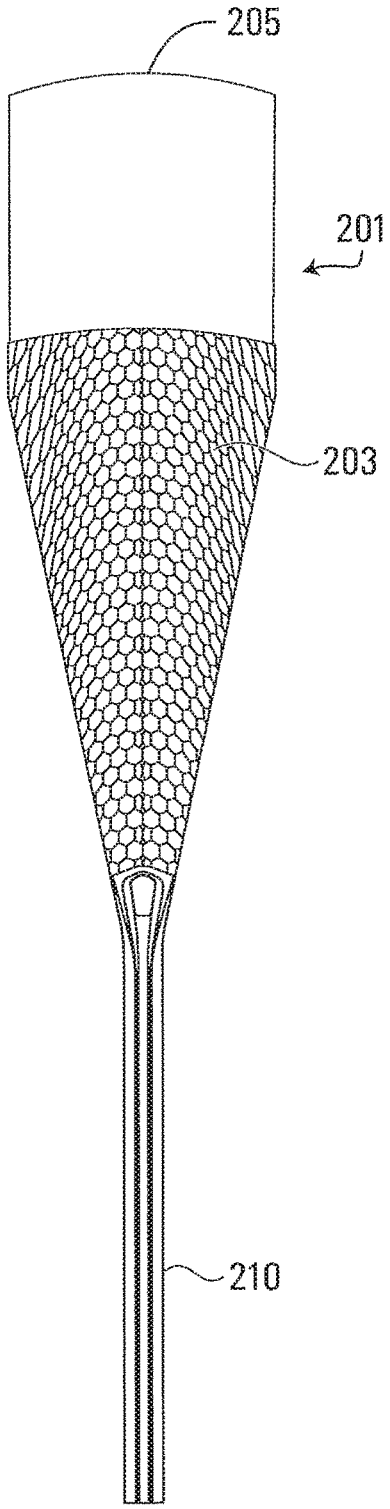
FIG. 13 is a plan view of a climbing skin tail with a strap and without a climbing skin attached.

FIG. 13 is a plan view showing a climbing skin tail 201 with features that generally correspond to those of the skin tip shown in FIG. 1. The rear attachment end of the skin tail is integral with strap 210. Illustrated gliding surface 203 comprises a grip pattern but it may also be absent in other embodiments. The length of the gliding surface can be a length as described above for a climbing skin tip. The region between the grip pattern and forward end 205 of the skin tail is a thinned area corresponding to the bib described above for a skin tip. This area can be used in joining the forward end of the climbing skin tail to the rearward end of a climbing skin by being sandwiched between layers of climbing skin material. Materials that may be used in manufacture of such a climbing skin tail are the same as described above for climbing skin tips.

Figure 14A:
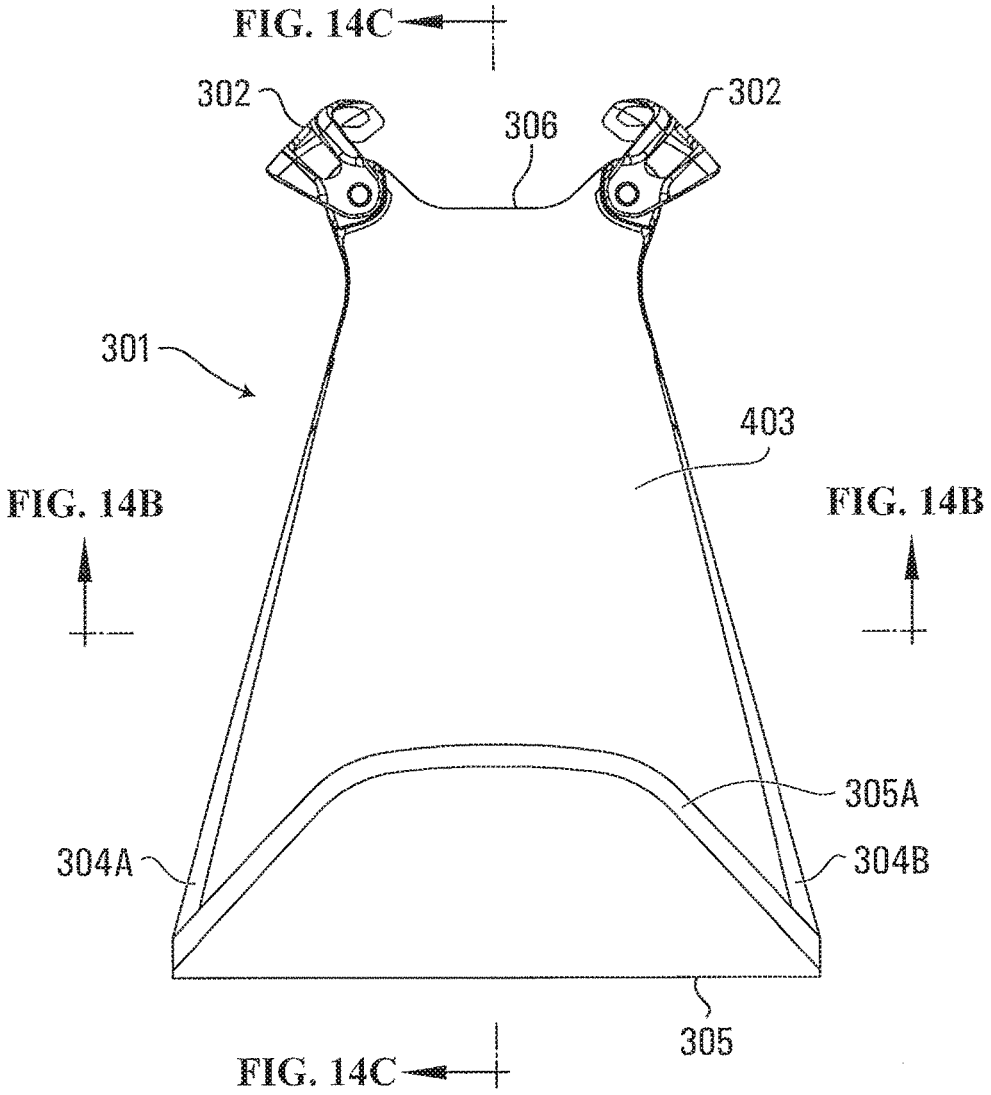
FIG. 14A is a plan view of a short version of a climbing skin comprising a curved resilient sheet such that its back surface comprises an arch.

FIG. 14A is a plan view of climbing skin tip 301 which is comprised of a resilient sheet that is curved in a transverse direction to provide an arched back surface. The illustrated embodiment comprises clips 302 for attachment at the tip of a ski or snowboard. In one variant, the skin tip comprises a plastic polymer sheet comprising a polyurethane with the sheet having a hardness of about 70 Shore D and a thickness selected to provide a flexural modulus of 400-500 Mpa. The gliding surface between leading edge 306 and boundary 305A in this particular embodiment is generally smooth but it can contain a grip pattern in other embodiments. The length of the gliding surface may be from about 100 mm or about 125 mm to about 150 mm, or it can be longer. Side edges 304A and 304B taper in height. The area between boundary 305A and rearward end 305 of the skin tip is a thinned area intended for use in joining to climbing skin material. Note that the thinned area in this embodiment is opposite in shape to the bib area in the embodiment shown in FIG. 1.

Figure 14C:
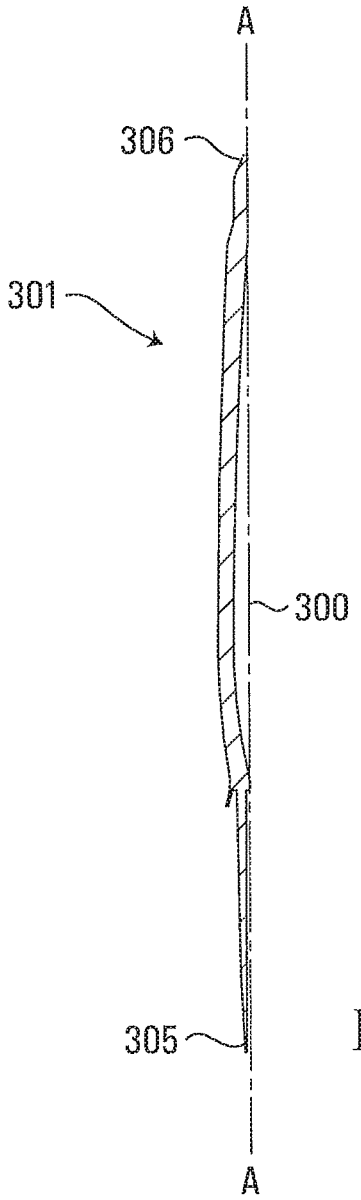
FIG. 14C is a section along line A-A of FIG. 14A showing a longitudinal curve resulting in a secondary arch on the back surface of climbing skin tip to facilitate bending around a convex undersurface at the tip of a ski or snowboard.
Figure 14B:
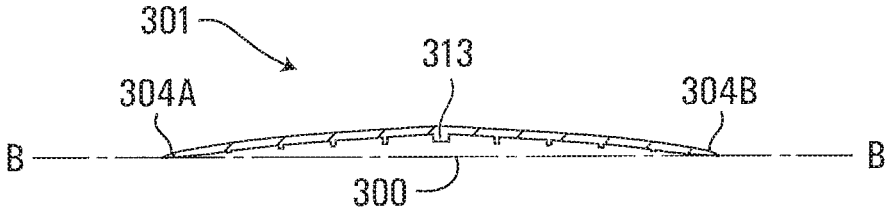
FIG. 14B is a cross section along line B-B of FIG. 14A on a notional plane showing a transverse arch creating a concavity on the back surface of the climbing skin tip.

FIG. 14B is a cross section from FIG. 14A. Notional planar surface 300 is shown to illustrate the arch formed by the curved sheet when laid flat with the arch having maximum height above planar surface 300 measured to the downward facing surface of ridge 313 on the back side of the skin tip. That height represents the height of the cavity that is present between the skin tip and planar surface when the skin tip is laid flat on that surface. In this case, the curve generally follows a section of a circle resulting in a symmetrical arch spanning substantially all the width of the climbing skin tip at line B-B. Pressure applied from above the arch illustrated in FIG. 14B is translated as transversely and downwards towards the side edges of the climbing skin tip. Furthermore, bending climbing skin tip 301 around the forward convex portion of a ski or snowboard also creates a force that is so translated resulting in contained pressure being applied towards the side edges of the climbing skin tip. FIG. 14C is a longitudinal section from FIG. 14A showing an optional feature where the skin tip is also curved longitudinally during the manufacturing process. This results in an intersecting, longitudinally oriented arch being present in the skin tip when at rest which can facilitate fit of the skin tip when bent around the forward convex region of a typical ski or snowboard. When laid flat along a planar surface, only the transverse curvature may be present resulting in a cavity like a barrel vault in the back surface. However when at rest, the presence of the longitudinal curve changes that cavity shape to one having positive Gaussian curvature.

Figure 15:
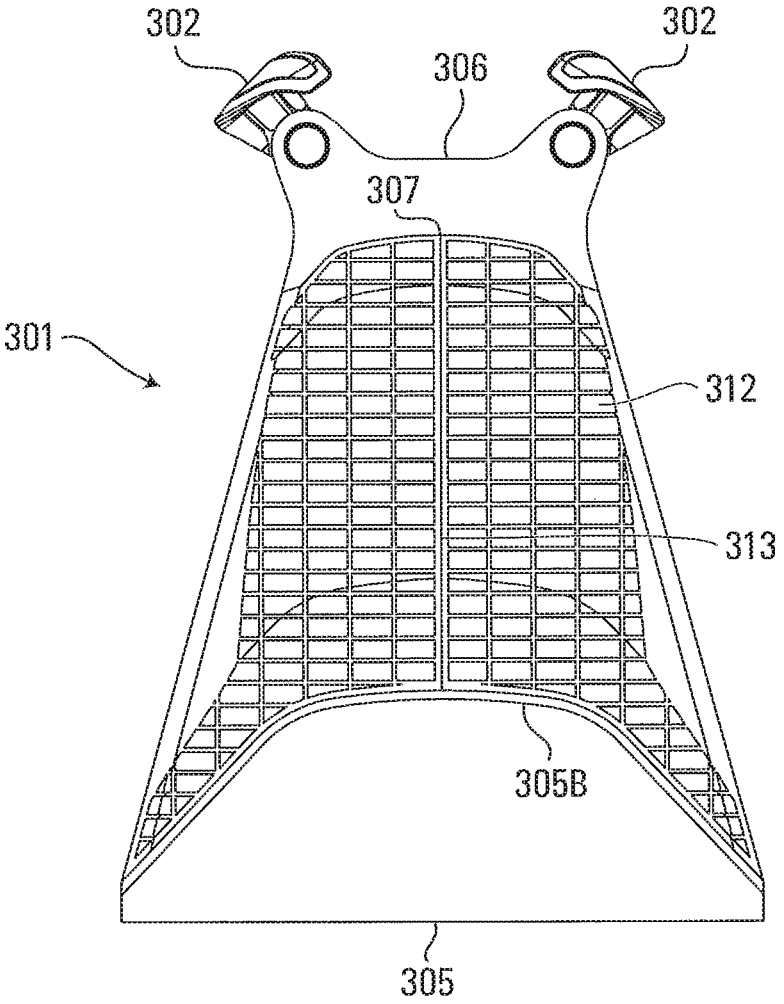
FIG. 15 is a plan view of the back surface of the climbing skin tip illustrated in FIG. 14A showing a cored surface with a pattern of ridges and depressions.

FIG. 15 shows the back surface of climbing skin tip 301 which contains coring resulting in depressions 312 separated by ridges 313. In this embodiment, the coring exists forward of boundary 305B. In the illustrated embodiment, the area between forward boundary 307 of the coring area extending rearward to 305B or to rearward end 305 represents a longitudinal section of skin tip 301 that in variants of the illustrated embodiments is curved in a generally transverse direction resulting in the arch described above. The surface shown in plan view in FIG. 15 is thus concave. When measuring the maximum height of the arch in this region above a real or notional planar surface, the measurement is from the planar surface to the outer surface of ribs 314 (the surfaces of the ribs in FIG. 15 facing the viewer).

Figure 16:
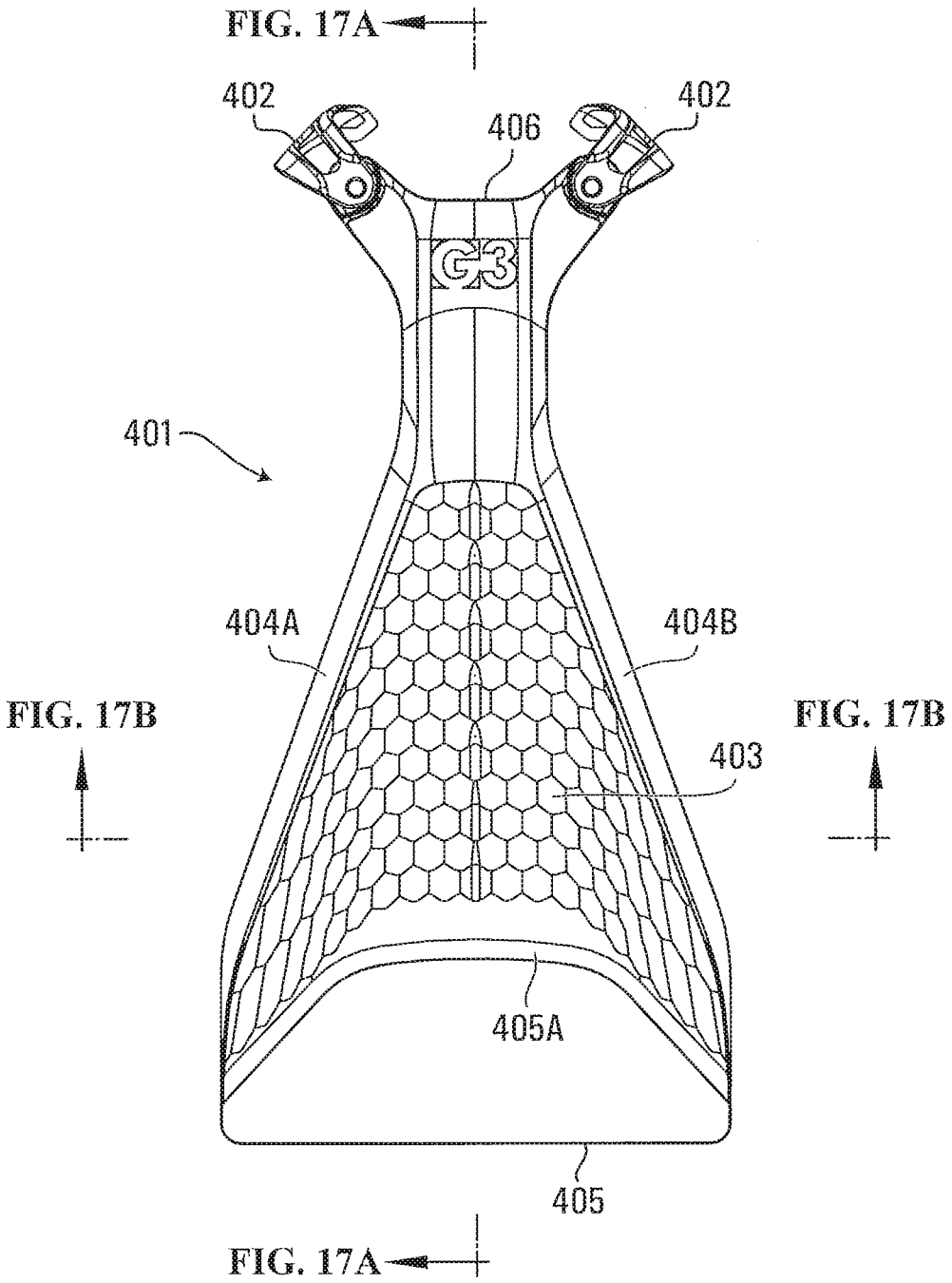
FIG. 16 is a plan view of a long variant of a climbing skin tip comprising a curved resilient sheet such that its back surface comprises an arch. In this embodiment, the gliding surface of the climbing skin tip bears a grip pattern.

FIG. 16 is a plan view of climbing skin tip 401 which is a variant of skin tip 301 in which the forward attachment end of the climbing skin tip represented at leading edge 406 is narrower in width than the rearward end 405 of the climbing skin tip resulting in side edges 404A and 404B diverging rearwardly from a central longitudinal axis (represented by line A-A) such that side edges 404A and 404B face obliquely towards the usual direction of travel. In this embodiment, the angle that the side edges diverge from the centre line is approximately 30°. In other variants, the angle may be less or up to about 45°. Side edges 404A and 404B are chamfered to reduce the profile of those edges. The area between rearward end 405 and boundary 405A is also a bib for use in attachment to a climbing skin. Clips 402 are present in this embodiment. The length of the sliding surface of this embodiment from end 406 to boundary 405A may be about 175 mm to about 250 mm, or longer.

Figure 17A:
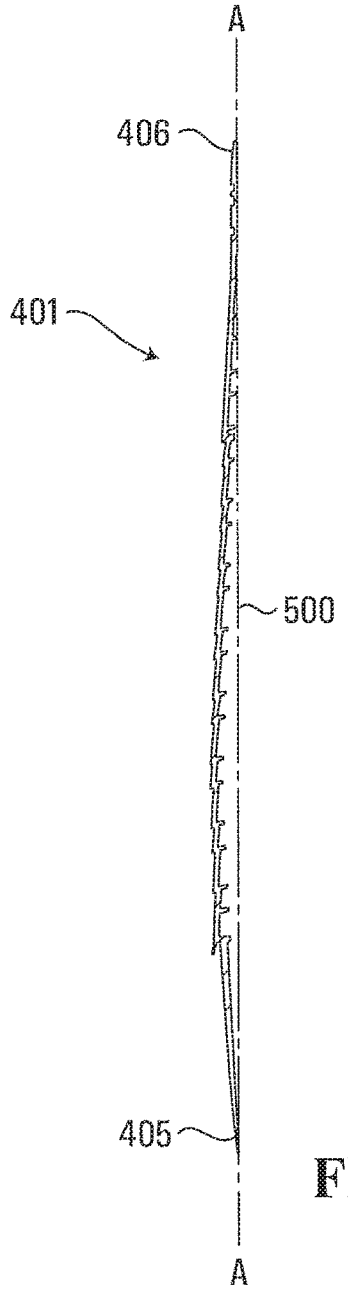
FIG. 17A and FIG. 17B are sections along lines A-A and B-B in FIG. 16 showing a secondary longitudinal arch and a transverse arch, respectively.
Figure 17B:
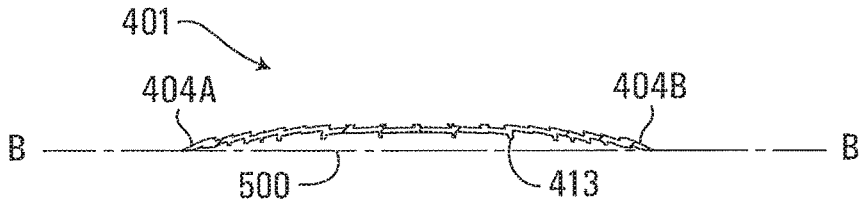

FIG. 17A and FIG. 17B illustrate the transverse and longitudinal arches present in climbing skin tip 401 as a result of its manufacture. These arches correspond to those described above for FIG. 14B and FIG. 14C.

Figure 18:
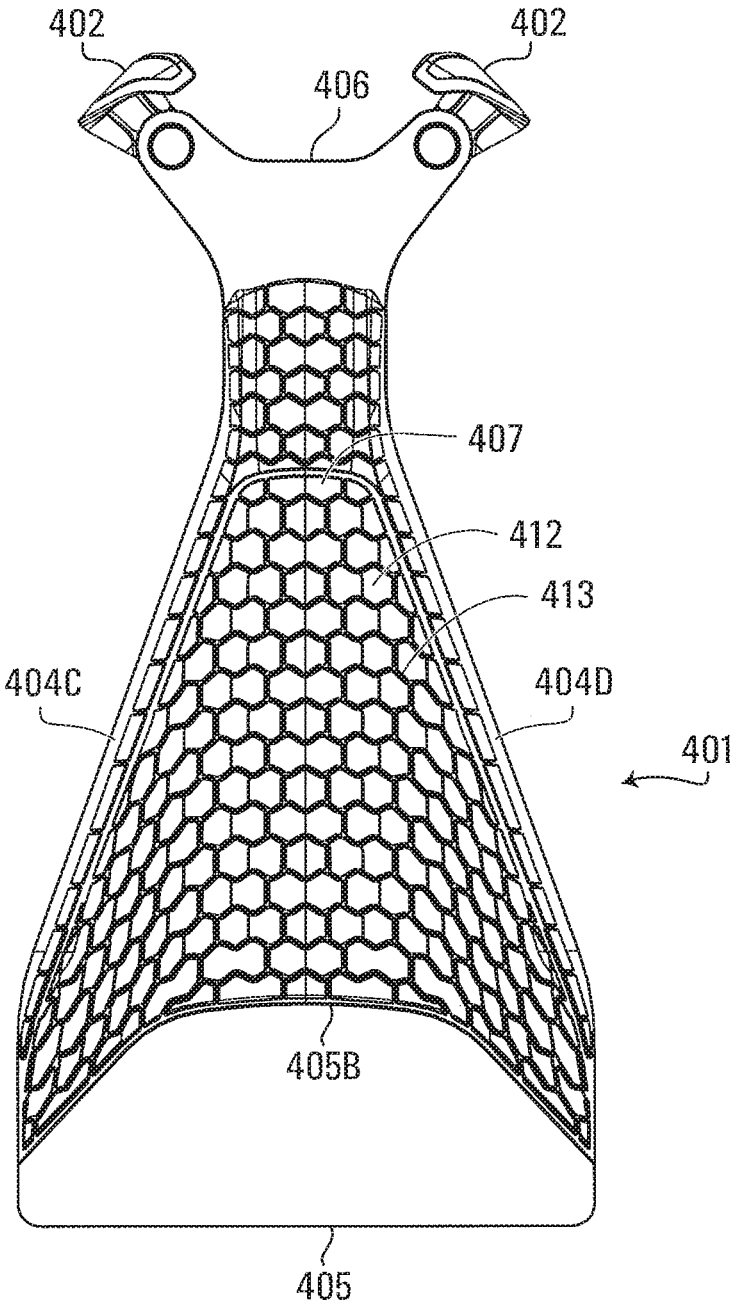
FIG. 18 is a plan view of the back surface of the climbing skin tip shown in FIG. 16 showing its coring pattern.

FIG. 18 is a plan view of the back surface of climbing skin tip 401 showing coring that includes depressions 412 and ridges 413. The height of the arch and hence the potential height of a concavity on the back surface is measured when the skin tip is laid flat along a real or notional planar surface from the planar surface to the outer surface of ridges 413. If ridges are not present, the measurement would simply be made to the back surface. In the illustrated embodiment, the longitudinal section containing the transverse curve exists between line 407 rearward to boundary 405B or to rearward end 405 with the remainder of the climbing skin tip going forward to leading edge 406 becoming relatively flat and not curved.

Figure 19:
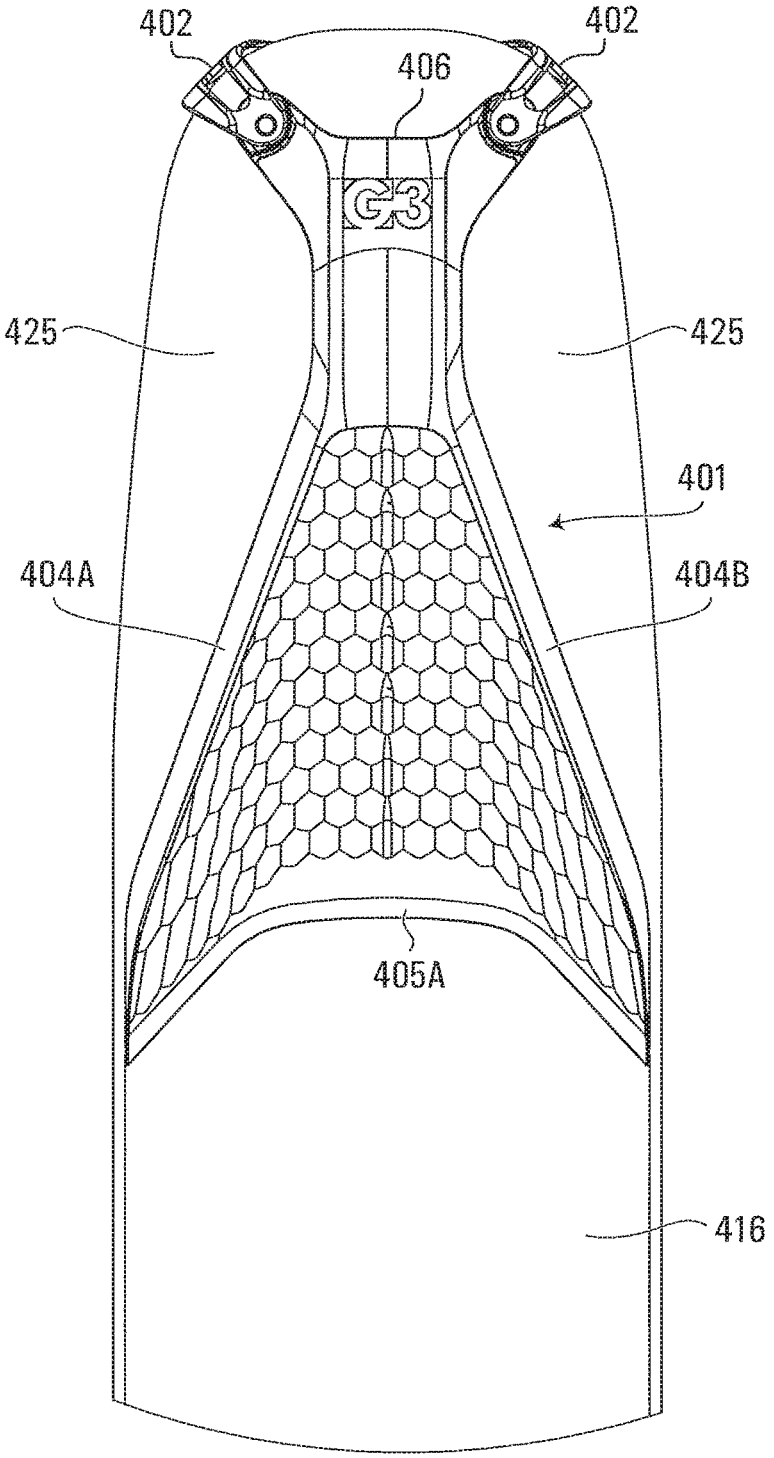
FIG. 19 is a partial view of the undersurface of the top of a ski with a climbing aid comprising the climbing skin tip illustrated in FIG. 16 attached to climbing skin material, mounted thereon.

FIG. 19 is a plan view of a climbing aid comprising climbing skin tip 401 joined to climbing skin material 416 installed on the undersurface of a ski. Only the most forward portion of the climbing aid and the tip of the ski are shown. The shape of climbing skin tip 401 being narrower at leading edge 406 as compared to the width of climbing skin material 416 exposes considerable amount of the undersurface at the tip of the ski at regions 425 which can improve glide. Presence of a longitudinal section within climbing skin 401 that is generally transversely curved plus bending of that section over the concave region of the ski existing at that location results in forces being continually transferred towards side edges 404A and 404B reducing tendency of snow to creep between the climbing skin tip with the undersurface of the ski at those areas.

Figure 20:
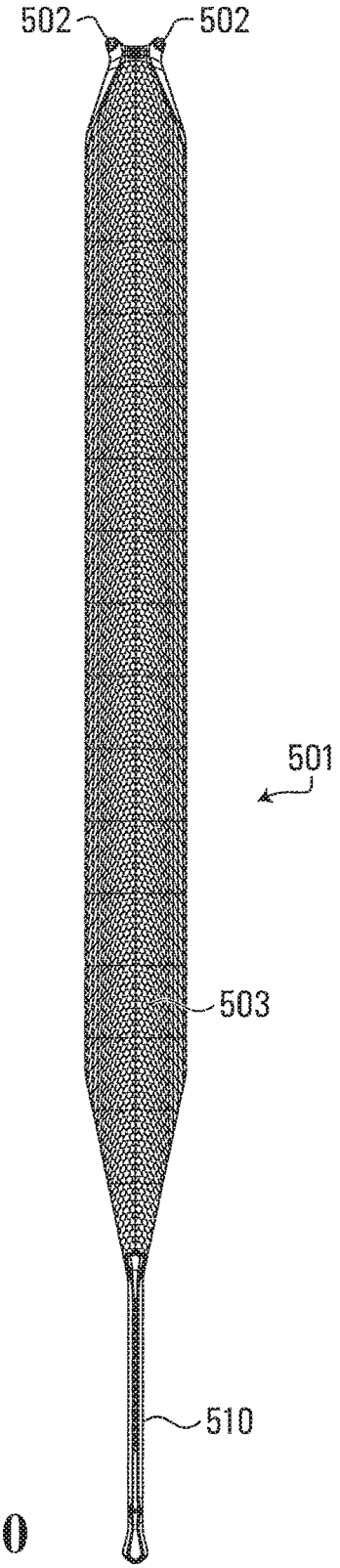
FIG. 20 is a plan view of the gliding surface of a climbing aid with clips at its forward end and a strap at its rearward end and which comprises a continuous, resilient sheet that is curved to provide a transverse arch on its back surface and which comprises a grip pattern on its gliding surface.

FIG. 20 shows an embodiment of a unitary climbing aid 501 in which the entirety of climbing aid forward of strap 510 is a sheet that is curved in a generally transverse direction to produce an arch on its back surface, substantially across the width of the climbing aid. In this embodiment, the forward attachment end of climbing aid 501 comprises clips 502. Although some or all of the gliding surface of climbing aid 501 may comprise a pile, in the illustrated embodiment, that surface bears grip pattern 503.

All patents, patent applications and publications referred to herein are hereby incorporated by reference.

Although the foregoing has been described in some detail by way of illustration and example for purposes of clarity of understanding, it will be readily apparent to those of skill in the art in light of the teachings of this application that changes and modification may be made without departing from the spirit and scope of the appended claims. The features recited in any one of the appended claims may be limited by or combined with the features of any other claim unless the context dictates otherwise.

We claim:

1. A climbing aid for use on snow comprising a glued climbing skin and one or both of a climbing skin tip and a climbing skin tail; the climbing skin tip comprising a forward attachment end, a rearward end joined to a leading end of the glued climbing skin and opposing gliding and back surfaces between said ends; the climbing skin tail comprising a rearward attachment end and a forward end joined to a rearward end of the climbing skin; wherein the one or both of said climbing skin tip and tail is comprised of a flexible sheet that is more rigid than the glued climbing skin, and wherein the back surface of the one or both of said climbing skin tip and tail is free of climbing skin adhesive and the gliding surface thereof has a minimum length of about 150 mm.

2. The climbing aid of claim 1, wherein the sheet comprises a plastic polymer with a hardness of about 0 Shore D to about 100 Shore D.

3. A climbing aid for use on snow comprising a climbing skin and one or both of a climbing skin tip and a climbing skin tail; the climbing skin tip comprising a forward attachment end, a rearward end joined to a leading end of the climbing skin and opposing back and gliding surfaces between said ends; the climbing skin tail comprising a rearward attachment end and a forward end joined to a rearward end of the climbing skin; wherein the one or both of said climbing skin tip and tail comprises a resilient sheet, the sheet comprising at least one longitudinal section that is curved in a generally transverse direction such that when laid flat, said back surface within the longitudinal section has the shape of at least a partial arch.

4. The climbing aid of claim 3, wherein the gliding surface of one or both of said climbing skin tip and tail has a minimum length of about 100 mm.

5. The climbing aid of claim 3, wherein the climbing skin also comprises at least one resilient sheet comprising at least one longitudinal section that is curved in a generally transverse direction such that when laid flat, the back surface within the longitudinal section has the shape of at least a partial arch.

6. The climbing aid of claim 5, wherein the sheet in one or both of said climbing skin tip and tail and the sheet of the climbing skin is a single sheet.

7. The climbing aid of claim 3, wherein the climbing skin is a glued climbing skin.

8. The climbing aid of claim 7, wherein the back surface of one or both of said climbing skin tip and tail is free of climbing skin adhesive.

9. The climbing aid of claim 3, wherein the maximum height of the arch when laid flat is at least about 1.5 mm, or at least about 2 mm, or at least about 2.5 mm, or at least about 3 mm.

10. The climbing aid of claim 3, wherein the arch is a symmetrical arch.

11. The climbing aid of claim 3, wherein the arch spans more than half, or spans at least about two-thirds or spans substantially all of the width of the climbing aid.

12. The climbing aid of claim 3, wherein the sheet comprises a plastic polymer having a hardness of at least 40 Shore D.

13. The climbing aid of claim 12, wherein the hardness is about 40 Shore D to about 100 Shore D, or about 40 Shore D to about 90 Shore D, or about 40 Shore D to about 80

Shore D, or about 55 Shore D to about 80 Shore D, or about 60 Shore D to about 80 Shore D, or about 65 Shore D to about 70 Shore D.

14. The climbing aid of claim 3, wherein the sheet is a plastic polymer sheet with a flexural modulus of about 200 Mpa to about 900 Mpa as determined according to ASTM D790-15e2.

15. The climbing aid of claim 14, wherein the flexural modulus is about 300 Mpa to about 800 Mpa, or about 300 Mpa to about 700 Mpa, or about 400 to about 600 Mpa, or about 500 Mpa.

16. The climbing aid of claim 3, wherein the sheet has an average thickness of about 0.5 to about 6 mm, or about 1 mm to about 5 mm, or about 1 mm to about 4 mm, or about 1 mm to about 3 mm, or about 1.5 mm to about 3 mm, or about 2 mm.

17. The climbing aid of claim 3, wherein the sheet comprises a thermoplastic polyurethane.

18. The climbing aid of claim 3, wherein the rearward end of the climbing skin tip when present, is of substantially the same width as the leading edge of the climbing skin; and, wherein the forward end of the climbing skin tail when present, is of substantially the same width as the rearward end of the climbing skin.

19. The climbing aid of claim 3, wherein the attachment end of the climbing skin tip when present, is narrower in width than the rearward end of the climbing skin tip; and, wherein the attachment end of the climbing skin tail when present, is narrower in width than the forward end of the climbing skin tail.

20. The climbing aid of claim 19, wherein one or both said climbing skin tip and tail has at least one side edge that diverges at an angle relative to a longitudinal axis of the climbing aid.

21. The climbing aid of claim 20, wherein the angle is about 45° or less.

22. The climbing aid of claim 3, wherein the gliding surface of one or both of said climbing skin tip and tail is smooth.

23. The climbing aid of claim 3, wherein the gliding surface of one or both of said climbing skin tip and tail bears a grip pattern.

24. The climbing aid of claim 3, wherein the climbing aid comprises said climbing skin tip.

25. The climbing aid of claim 24, further comprising at least one clip at the attachment end of the climbing skin tip for use in attachment of the climbing aid to a ski or snowboard, the clip being shaped to extend over one or both of the opposite side edges of the tip of the ski or snowboard.

26. The climbing aid of claim 3, further comprising one or more straps at a rearward end of the climbing aid for use in attachment of the climbing aid at the tail of a ski or snowboard.

27. The climbing aid of claim 3, wherein the climbing skin has a pile surface that is generally contiguous with the gliding surface of one or both of said climbing skin tip and tail.

28. The climbing aid of claim 3, wherein the climbing skin has a grip pattern surface.

29. A climbing aid component for use in manufacture of a climbing aid comprising a climbing skin for use on snow, wherein the component is a climbing skin tip or a climbing skin tail; the climbing skin tip comprising a forward attachment end, a rearward end and opposing back and gliding surfaces between said ends; the climbing skin tail comprising a rearward attachment end, a forward end and opposing back and gliding surfaces between said ends; wherein the component comprises a resilient sheet, the sheet comprising at least one longitudinal section that is curved in a generally transverse direction such that when laid flat, the back surface within the longitudinal section has the shape of at least a partial arch, and wherein the gliding surface has a minimum length of about 100 mm.

30. The climbing aid component of claim 29, which is produced by molding of a polymer comprising a thermoplastic polyurethane and wherein the resilient sheet has a flexural modulus of about 200 Mpa to about 900 Mpa, as determined according to ASTM D790-15e2.

* * * * *